US006217208B1

(12) United States Patent
Schuchardt

(10) Patent No.: US 6,217,208 B1
(45) Date of Patent: Apr. 17, 2001

(54) HEATABLE STATIC MIXING DEVICE WITH UNDULATING OR ZIGZAG BARS

(75) Inventor: Heinrich Schuchardt, Leverkusen (DE)

(73) Assignee: Bayer Aktiengesellschaft (DE)

( * ) Notice: Subject to any disclaimer, the term of this patent is extended or adjusted under 35 U.S.C. 154(b) by 0 days.

(21) Appl. No.: 09/334,298

(22) Filed: Jun. 16, 1999

(30) Foreign Application Priority Data

Jun. 23, 1998 (DE) ..... 198 27 851

(51) Int. Cl.[7] ..... B01F 5/06
(52) U.S. Cl. ..... 366/147; 366/337
(58) Field of Search ..... 366/9, 147, 181.5, 366/336, 337, 340, 341; 165/109.1; 138/38, 40, 42

(56) References Cited

U.S. PATENT DOCUMENTS

| | | | | |
|---|---|---|---|---|
| Re. 34,255 | * | 5/1993 | Friedrich | 138/42 |
| 3,406,947 | * | 10/1968 | Harder . | |
| 3,620,506 | * | 11/1971 | So . | |
| 4,040,256 | * | 8/1977 | Bosche et al. | 138/42 |
| 4,062,524 | | 12/1977 | Brauner et al. . | |
| 4,296,779 | | 10/1981 | Smick . | |
| 4,314,606 | * | 2/1982 | Muller et al. . | |
| 5,171,544 | | 12/1992 | Lang . | |
| 5,492,408 | * | 2/1996 | Alfare | 366/337 |
| 5,851,067 | * | 12/1998 | Fleischli et al. | 366/337 |
| 5,964,528 | * | 10/1999 | Suess et al. | 366/337 |
| 5,971,603 | * | 10/1999 | Davis et al. | 366/337 |

FOREIGN PATENT DOCUMENTS

| | | |
|---|---|---|
| 1 601 205 | 8/1970 | (DE) . |
| 28 39 564 | 3/1980 | (DE) . |
| 28 39 564 C2 | 10/1982 | (DE) . |
| 44 28 813 A1 | 2/1996 | (DE) . |
| 0 412 177 A1 | 2/1991 | (EP) . |

OTHER PUBLICATIONS

"Mischen beim Herstellen und Verarbeiten von Kunststoffen" published by VDI–Verlag, Dusseldorf, 1986 (pp. 238–241).

* cited by examiner

*Primary Examiner*—Charles E. Cooley
(74) *Attorney, Agent, or Firm*—Connolly Bove Lodge & Hutz LLP

(57) ABSTRACT

A static mixer apparatus for mixing viscous fluids is constructed from an inner housing (2) which has an inlet for material to be mixed (7) and an outlet for material to be mixed (8) and which comprises two or more layers of undulating or zigzag bars (1; 2) which are parallel to each other and which are disposed one above another rotated by an angle α, preferably of 90°, to each other in an alternating manner and which are joined to each other at their upper or lower vertices. The bars (3, 1; 4, 14) are provided in particular with channels (6, 16; 5, 15) for the passage of a heat transfer fluid so that the mixer can also be employed as a heat exchanger.

7 Claims, 16 Drawing Sheets

HEATABLE STATIC MIXING DEVICE WITH UNDULATING OR ZIGZAG BARS

BACKGROUND OF THE INVENTION

This invention relates to a static mixer apparatus for mixing viscous fluids which is constructed from an inner housing which has an inlet for material to be mixed and an outlet for material to be mixed and which comprises two or more layers of undulating or zigzag bars which are parallel to each other and which are disposed one above another rotated by an angle $\alpha$, preferably of 90°, to each other in an alternating manner and which are joined to each other at their upper or lower vertices. The bars are provided in particular with channels for the passage of a heat transfer fluid so that the mixer can also be employed as a heat exchanger.

Static mixers are often employed as built-in components for the mixing of liquids in pipelines. A pump pushes the liquids to be mixed through a pipe which is provided with built-in components such as these.

The two following apparatuses can be cited as examples of static mixers.

In what are termed Kenics mixers (see "Mischen beim Herstellen und Verarbeiten von Kunststoffen", published by: VDI-Ges. Kunststofftechnik. VDI-Verlag Düsseldorf, 1986, pages 238–241) the flow of fluid is divided by a separator plate installed in the pipe. This plate is twisted about the pipe axis. A swirling flow occurs in each of the two partial flows of liquid, and results in the redistribution of the liquid over the cross-section thereof. In practice, there is a plurality of mixing elements such as this disposed in series in order to divide the liquid again and again and to achieve a good mixing effect. The stability under pressure of these mixers when employed for highly viscous fluids is comparatively low.

What are termed SMX mixers (see U.S. Pat. No. 4,062,524) consist of two mutually perpendicular grids of parallel sheet metal strips which are welded to each other at their points of intersection. On account of the many weld joints, the production cost of these mixers is relatively high.

The exchange of heat from or to highly viscous liquids during their passage through known heat exchangers typically occurs at a very low Reynolds number. If plain tubes are used for the exchange of heat, for example, the rate of exchange of heat is low at a Reynolds number which tends to zero, and on the heat exchanger side depends substantially only on the length of tube used. It is possible to achieve a significant improvement in the exchange of heat by combining a tubular heat exchanger with a static mixer device.

This combination is known in two embodiments. Firstly, static mixer elements can be inserted in the tubes of a tube bundle heat exchanger. The aforementioned Kenics mixer elements are used in particular here. Secondly, the tubes can be employed as elements of a static mixer. This is described in German Patent Specification DE 28 39 564 C2, for example.

The use of a tube bundle heat exchanger through which a product flows has to be rejected for many chemical processes, however. For example, if a polymerisation reaction has to be cooled, a higher degree of polymerisation is obtained in a tube through which slow flow occurs, due to the increased dwell time of the reactants. The liquid in the tube thereby possibly becomes more viscous than that in adjacent tubes. As a consequence, the velocity of flow of the material to be mixed is further reduced. For a given set of process parameters, the tube can therefore become blocked by polymer.

In processes such as these, a static mixer is preferred which is formed from heat exchanger tubes, such as that described in DE 28 39 564 C2. However, the production cost of these mixers is so high that this solution is frequently rejected as being uneconomic.

SUMMARY OF THE INVENTION

The object of the present invention is to identify a static mixer which exhibits a good mixing effect which is comparable with that of known mixers, which can optionally be cooled or heated, and which can be manufactured in a simple manner and therefore inexpensively.

This object is achieved according to the invention by a static mixer apparatus for mixing viscous fluids, which is constructed at least from an inner housing which has an inlet for material to be mixed and an outlet for material to be mixed and which comprises two or more layers of undulating or zigzag bars which are parallel to each other and which are disposed one above another rotated by an angle $\alpha$, preferably of 90°. to each other in an alternating manner and which are joined to each other at their upper or lower vertices. and which optionally comprises an outer shell.

In its highly symmetrical preferred embodiment, the bars of the static mixer are joined to each other by junction points so that four bar elements which span a tetrahedron originate from each junction point, except for the junction points which are situated at the edge of the static mixer. In this embodiment, the construction of the bar insert has a topology which resembles that of a diamond lattice. The term "bar insert" is to be understood as the totality of the layers of bars of the mixer which are joined to each other.

In one preferred embodiment of the static mixer apparatus, the bars of selected layers or of all the layers are provided with channels for the passage of a heat transfer fluid. The bars are of hollow construction, for example, and the hollow spaces then serve as channels for the heat transfer medium.

In one particularly preferred embodiment, the width of the bars in the direction of flow of the product is designed such that said heat transfer channels are each conducted along a straight line through the bars, from one side of the mixer to the opposite side.

The production of a mixer apparatus such as this is thereby simplified even further, since during the injection moulding of the mixer pattern lateral mould slides can be used in order to form the channels in the bars.

A variant of the static mixer apparatus which is particularly easy to manufacture is characterized in that the apparatus is subdivided into two or more separate segments which are stacked one above the other and in each of which two, three or more layers of bars are joined together. The segments can be produced individually by casting and any number and combination thereof can subsequently be joined to each other, optionally with individual segments even having different geometries.

In one preferred form of the invention, the bars of directly superimposed layers of bars overlap at their junction points, particularly by means of recesses which fit within one another at the vertices of the bars.

Another preferred variant of the mixer apparatus is characterised in that the parallel bars of a layer of bars are disposed laterally displaced in relation to the centre spacing of adjacent bars of the next layer of bars situated above them or below them in each case.

To achieve a further improvement of the mixing effect, particularly for highly viscous fluids, the layers of bars are set at an angle β, which is less than or greater than 90°, in relation to the main direction of flow of the material to be mixed from the inlet for material to be mixed to the outlet for material to be mixed.

The mixer is constructed in particular so that the grid planes which are formed by the junction points of the bars of a layer are placed so that none of them is at an angle of 90° to the main direction of flow through the mixer. The flow is thereby prevented from disintegrating into flow pockets (partial flows) which do not mix with each other.

The mixer can be produced in a simple manner by pre-moulding. This results in the desired low manufacturing cost, whereby the cost of the mixer can be kept low. For example, the bar insert-of the mixer can first of all be injection moulded from wax as a model. The wax model then serves as the lost pattern in a lost-wax casting process in which a ceramic hollow mould is produced from the wax model, for example. The bar insert, which is produced from metal which is cast in the hollow mould, can then be inserted and fixed in a housing a simple manner.

The aforementioned mixer variant consisting of segments is even simpler to manufacture, since the inner housing is produced together with the bars during the lost-wax casting process.

In a mixer with heat exchanger channels, the channels can also be welded to the housing wall. The automatic welding machines which are customarily used for the production of tube bundle heat exchangers can be employed for this purpose.

BRIEF DESCRIPTION OF THE DRAWINGS

The invention is explained in more detail below by way of examples and with reference to the Figures, without the invention thereby being limited to the details thereof.

The Figures are as follows.

EXAMPLES

Example 1

Figure 1A:
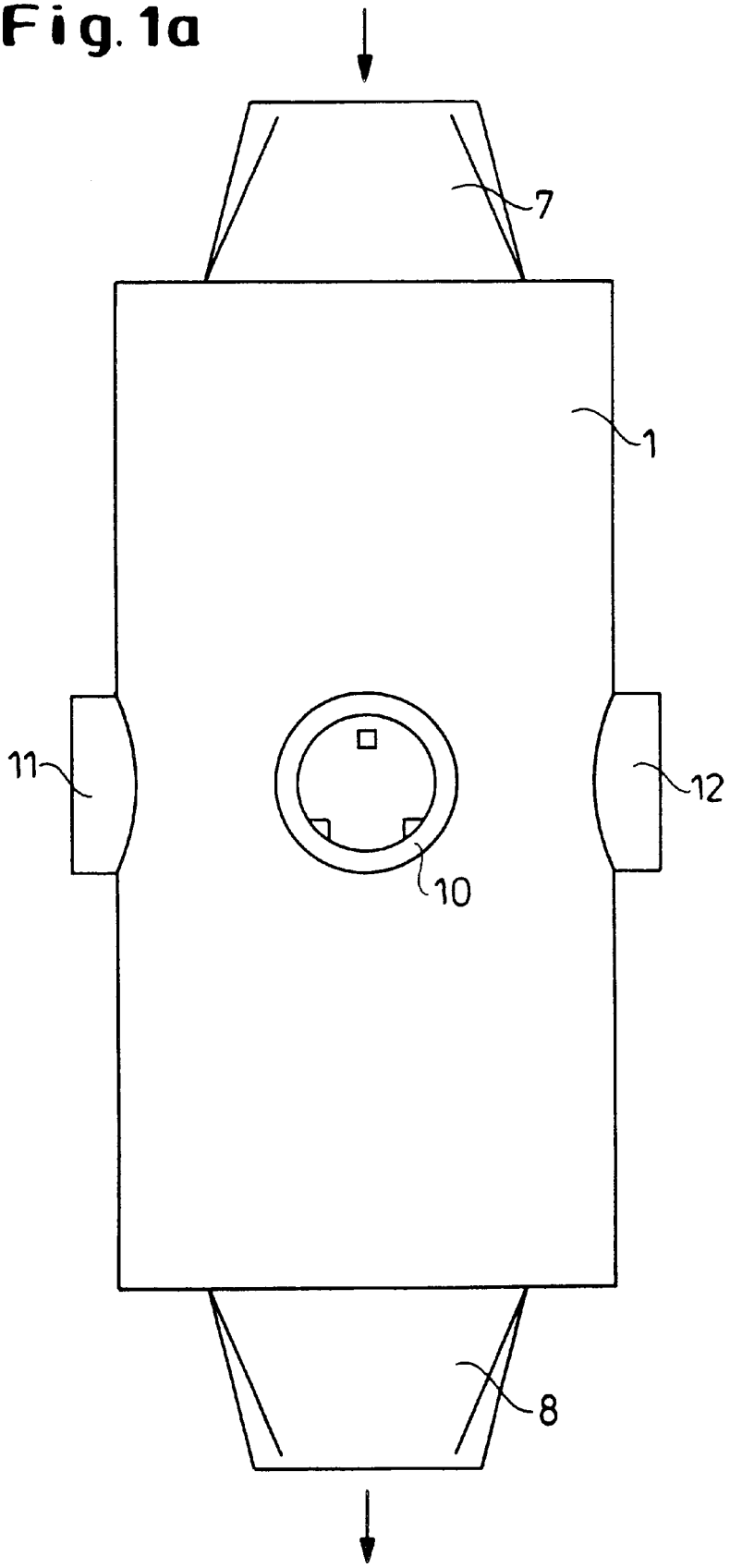
FIG. 1*a* is a simplified schematic front view of a static mixer according to the invention which can be heated or cooled and which comprises an external housing 1, an inlet for material to be mixed 7 and an outlet for material to be mixed 8.

FIG. 1*a* is a side view of an embodiment of the static mixer according to the invention. The bar insert and the inner housing of the mixer are surrounded by an external housing (shell 1) and comprise an inlet 7 and an outlet 8 for the material to be mixed.

Figure 1B:
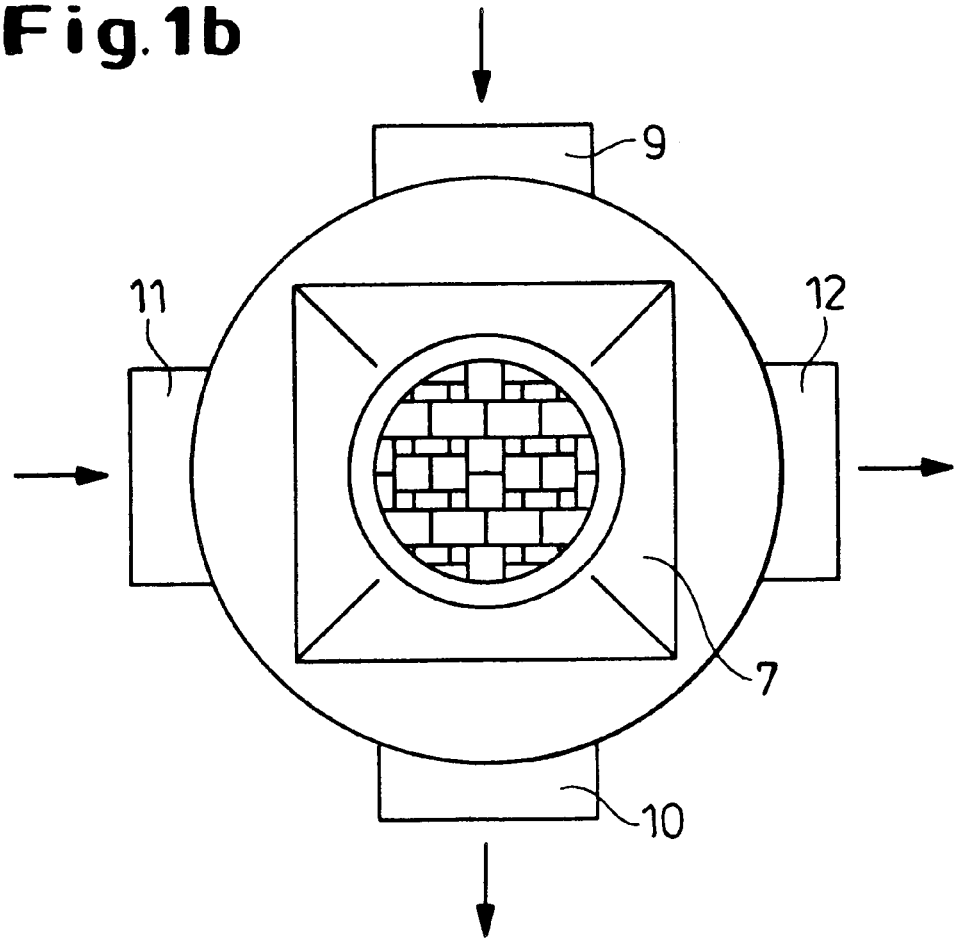
FIG. 1*b* is a plan view of the mixer shown in FIG. 1*a;*

In addition, the mixer is provided with feed lines 9 and 11 for a heat transfer oil and with discharge lines 10 and 12 for the heat transfer oil. In the plan view of the inlet for material to be mixed 7 which is shown in FIG. 1*b,* the built-in components of the mixer can be seen.

Figure 2:
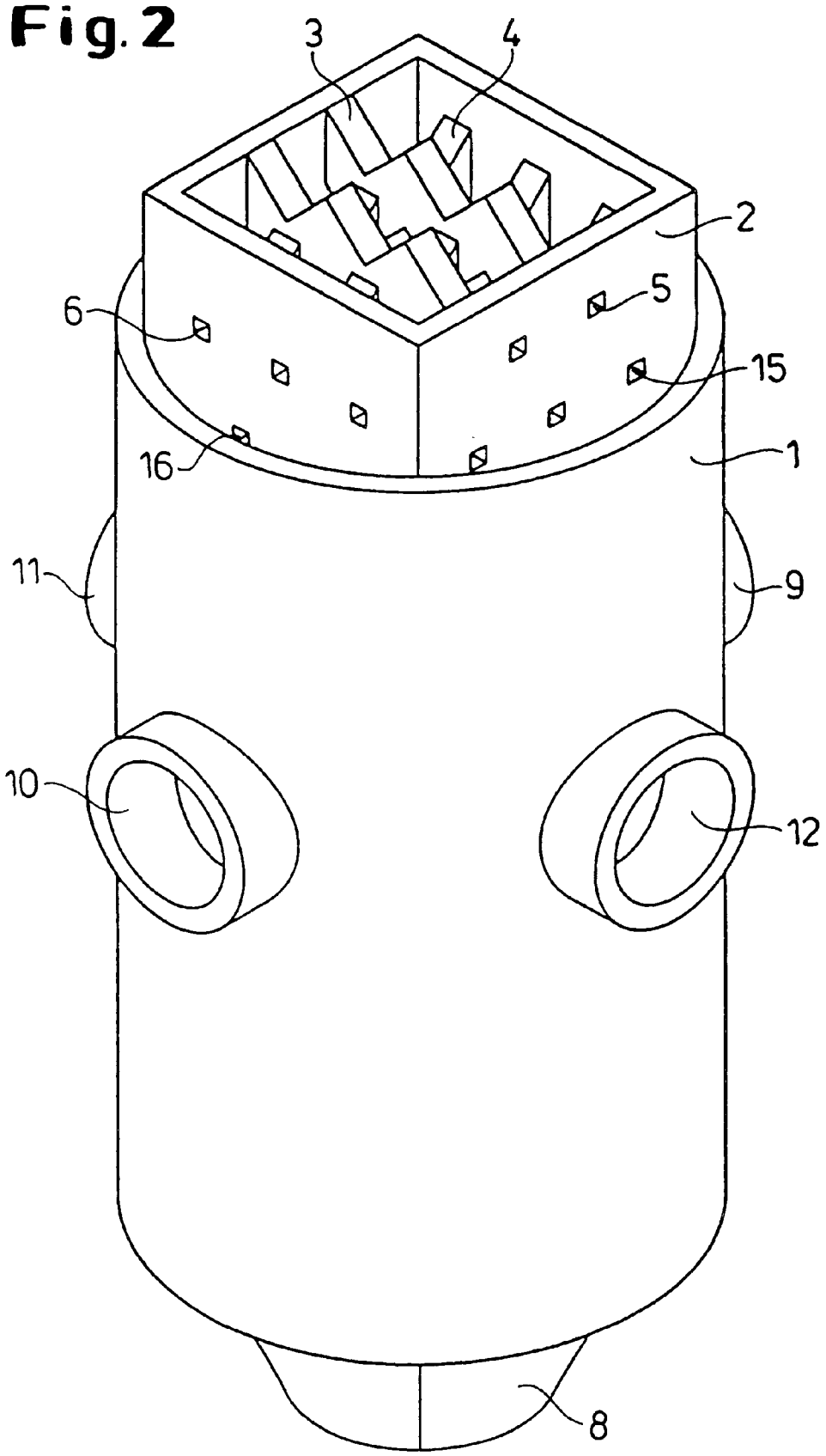
FIG. 2 is an isometric view of the static mixer shown in FIGS. 1*a* and 1*b,* wherein part of the external housing 1 and of the product inlet nozzle 7 are not illustrated.

The isometric view illustrated in FIG. 2 shows how the inner housing 2 is inserted together with the bar insert 3, 4 into the shell 1.

Figure 3A:
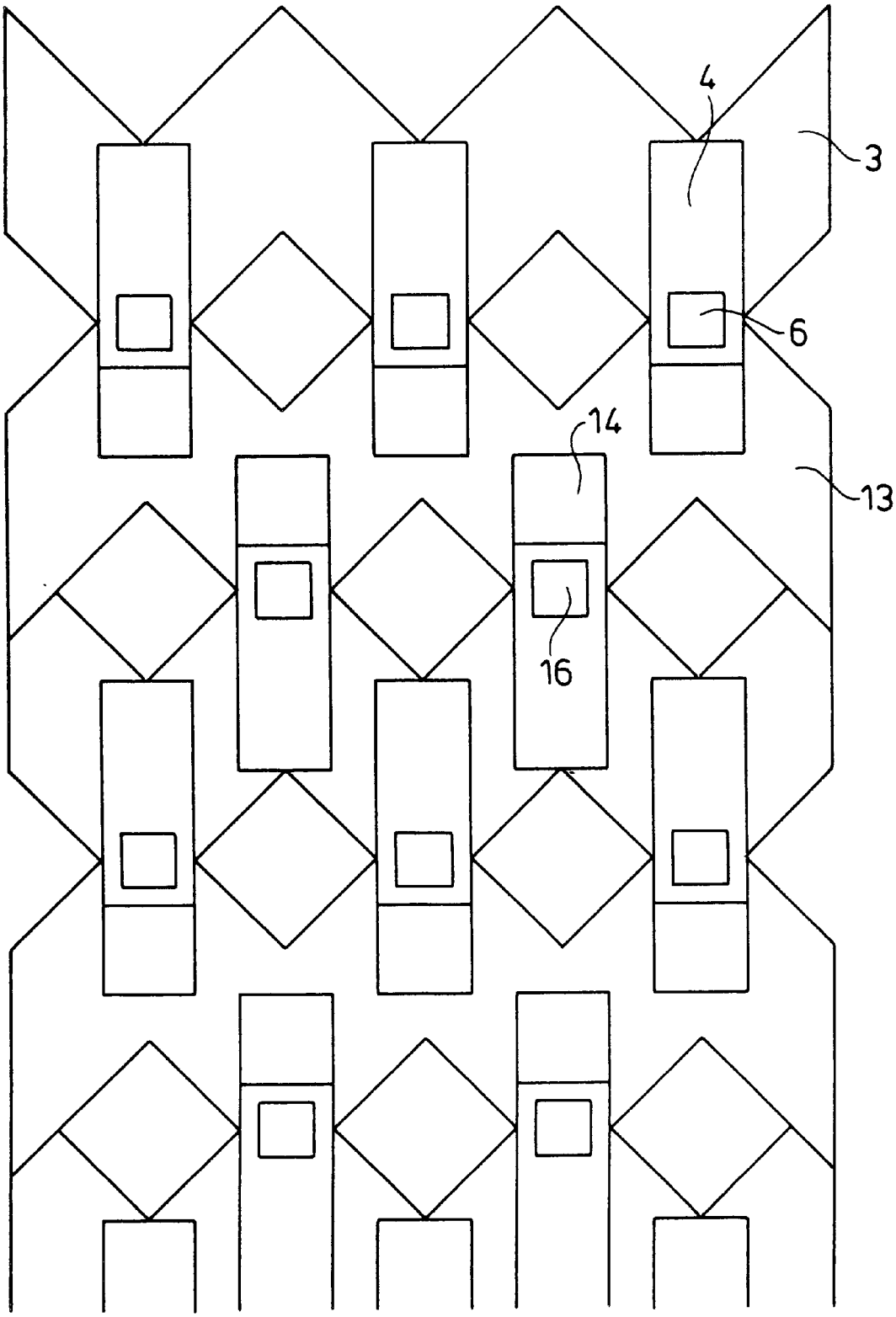
FIG. 3*a* is a front view of the uppermost layers of bars 3, 13 and 4, 14 in the mixer shown in FIG. 1*a;*

In order to clarify the construction of the mixer, FIG. 3*a* is a front view of the mixer with the inner housing 2 and shell 1 omitted.

The width of the bars 3, 13 and 4, 14 in the direction of flow is kept such that straight cooling channels 6, 16 can pass through them.

Figure 3B:
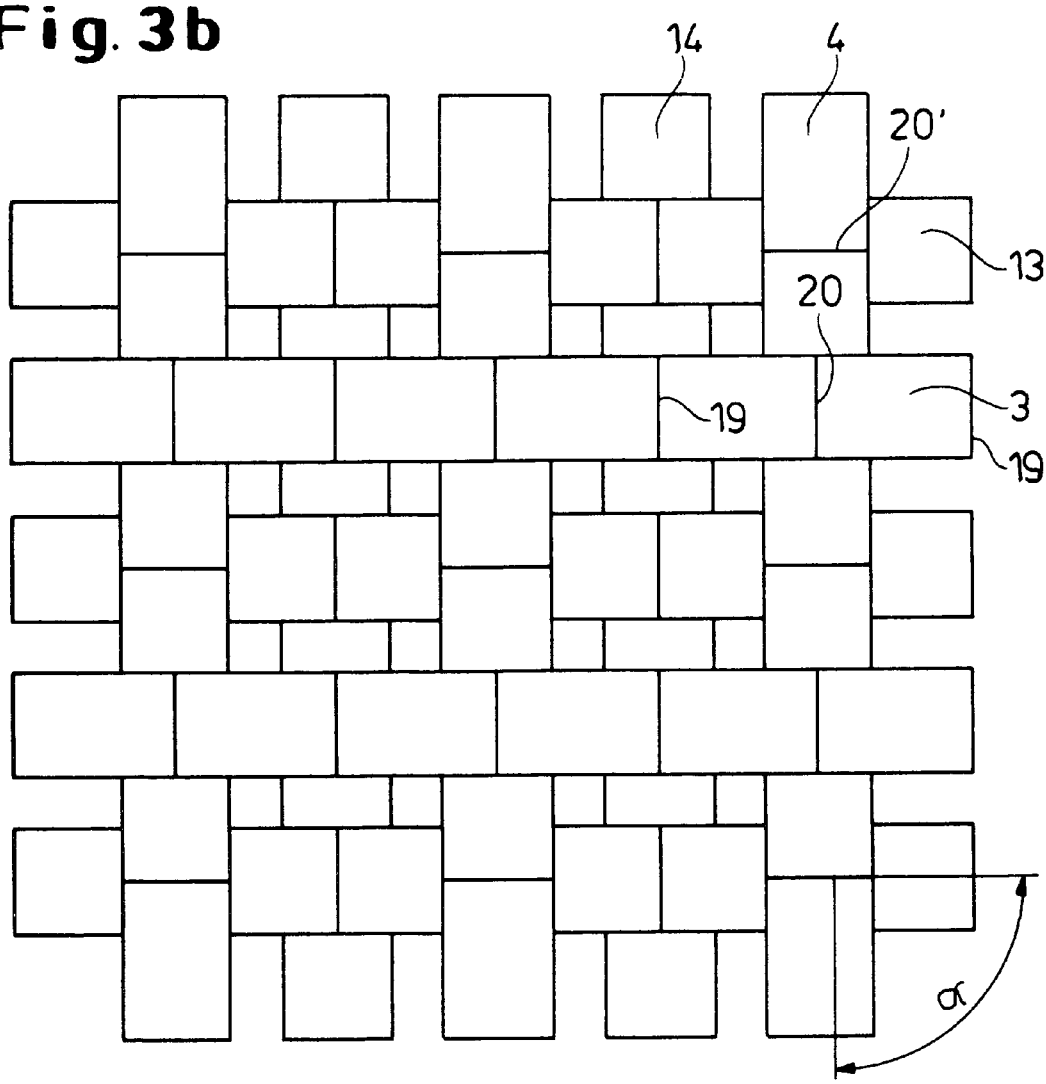
FIG. 3*b* is a plan view corresponding to FIG. 3*a;*

FIG. 3*b* is a schematic view, taken from the end comprising the inlet for material to be mixed 7, of the bar insert of the mixer shown in FIG. 1*a* without the housing 2 and shell 1. This clearly shows the sequence of the first four layers of bars. The uppermost layer is formed by the bars 3, the second layer is formed by the bars 4, and the third layer is formed by the bars 13, followed by the fourth layer of bars 14. The flow of material to be mixed is divided at each of the edges 19 and is conveyed to the troughs 20 in the bars. Lower layers of bars have troughs 20', from each of which the material to be mixed flows off laterally. The angle α, preferably 90° C., represents the offset of one layer of the bars from an adjacent alternating layer.

Figure 3C:
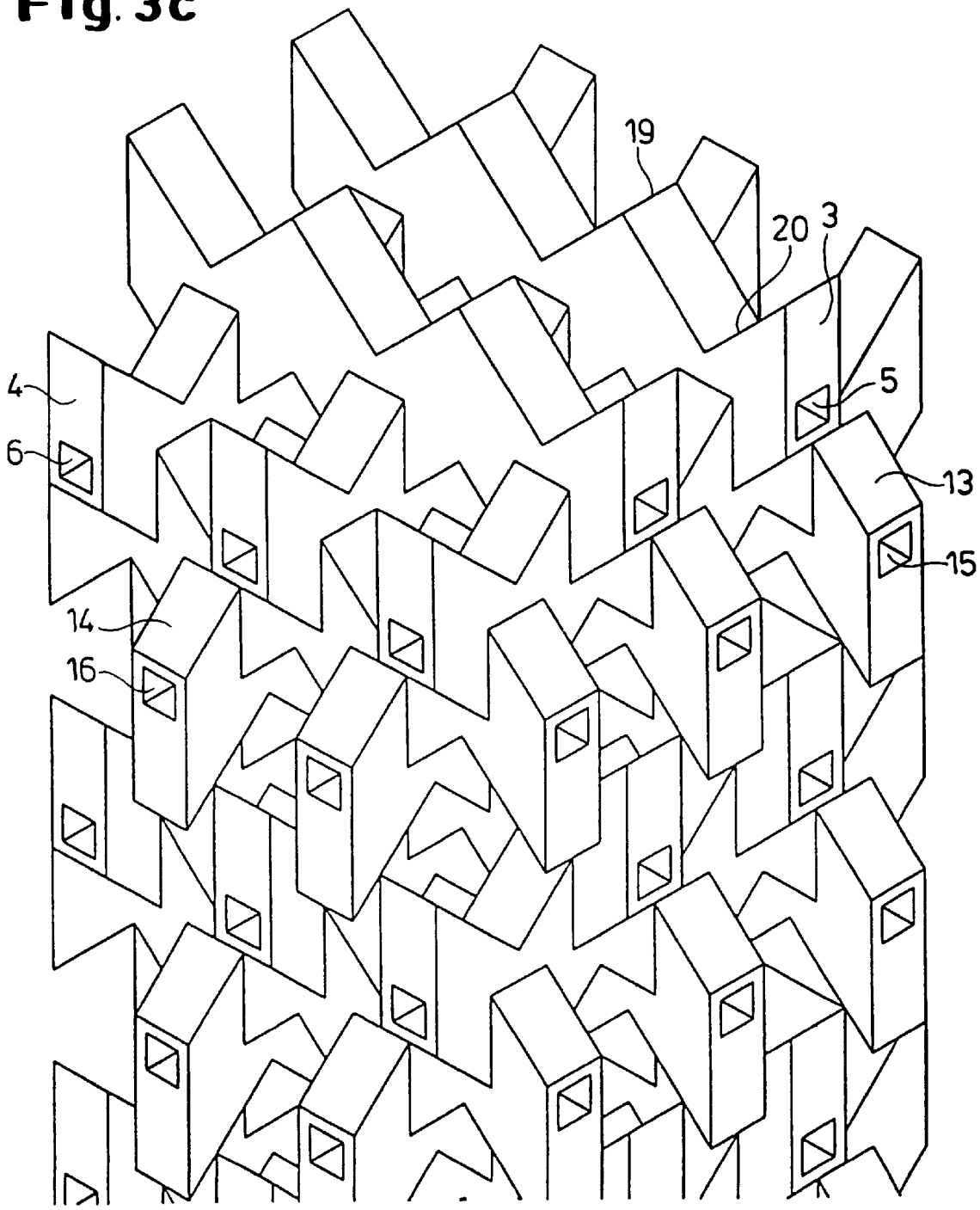
FIG. 3*c* is an isometric view corresponding to FIG. 3.
Figure 9:
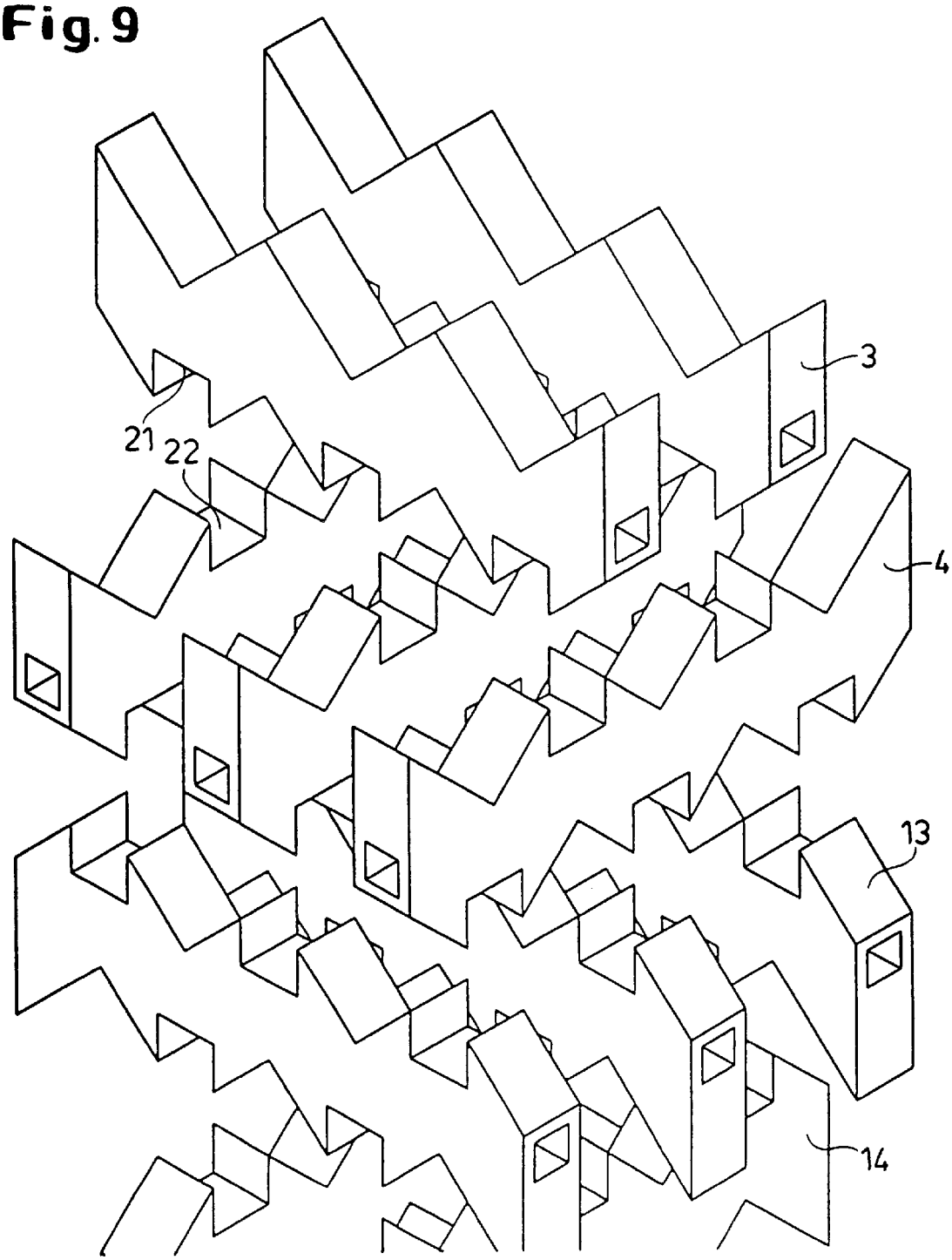
FIG. 9 shows the bar insert of FIG. 3*c* with the bars separated.

FIG. 3*c* again shows the sequence of the layers of bars which are joined to each other. In this embodiment the zigzag bars 3, 13 and 4, 14 have recesses 21, 22 (see FIG. 9) at their edges which face another layer, so that the recesses of directly adjacent bars fit within one another in such a way that an interleaved assembly of bars is formed which is torsionally rigid.

Example 2

Figure 4:
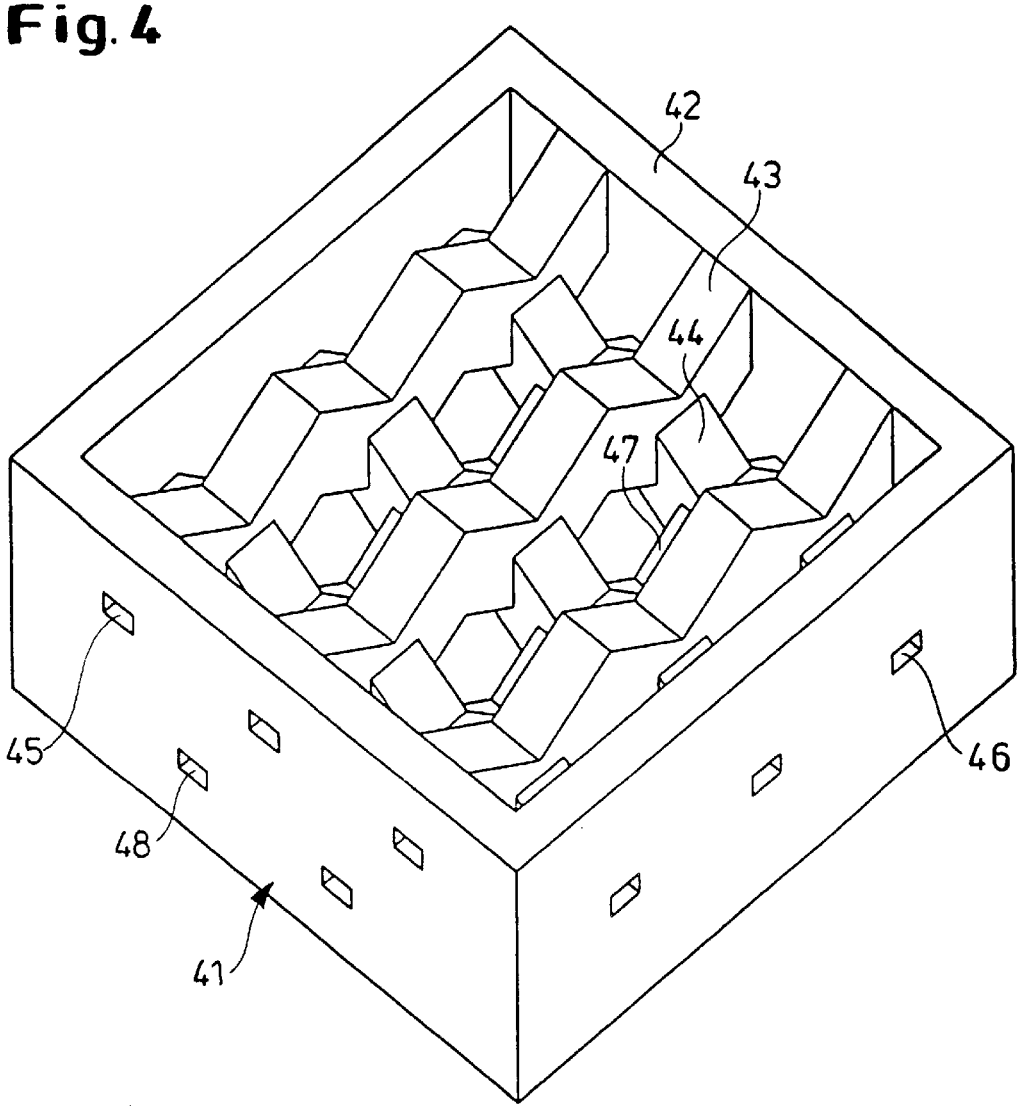
FIG. 4 shows a mixer segment 41 with three layers of bars 43, 44 and 47 disposed one above another.

FIG. 4 shows a segment 41 of a static mixer which comprises three layers of bars 43, 44 and 47.

The bars 43 of one layer are disposed parallel to each other. The rows of bars 43 and 44 situated directly underneath are each disposed perpendicularly to each other. Straight channels 45, 46, 48, through which a heat transfer fluid can flow and which lead into the wall of an inner housing 42, pass through all the bars 43, 44, 47. A plurality of segments 41 can form a packing, in which the segments are optionally joined to each other with seals which are not shown, and which is fitted into a shell (not shown). The segment can easily be produced by means of a metal casting process.

Example 3

Figure 5A:
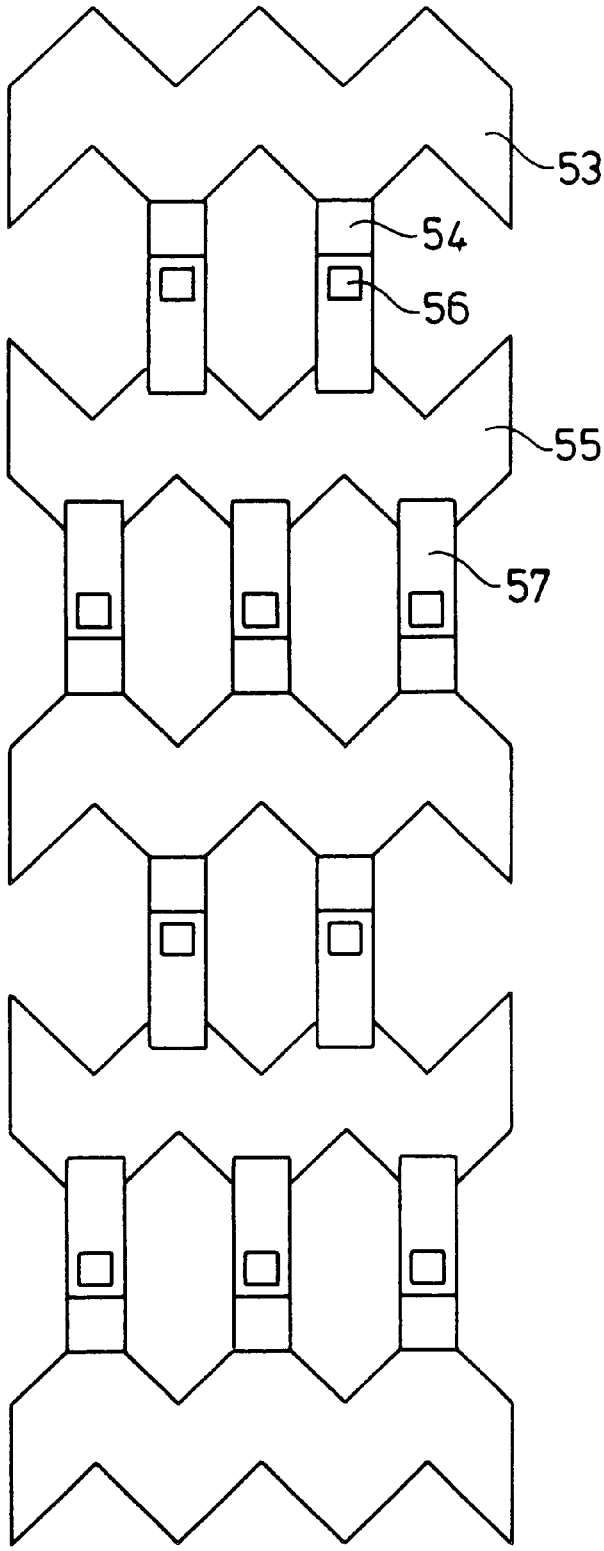
FIG. 5*a* shows the construction of a bar insert for another mixer which can be manufactured by casting.
Figure 5B:
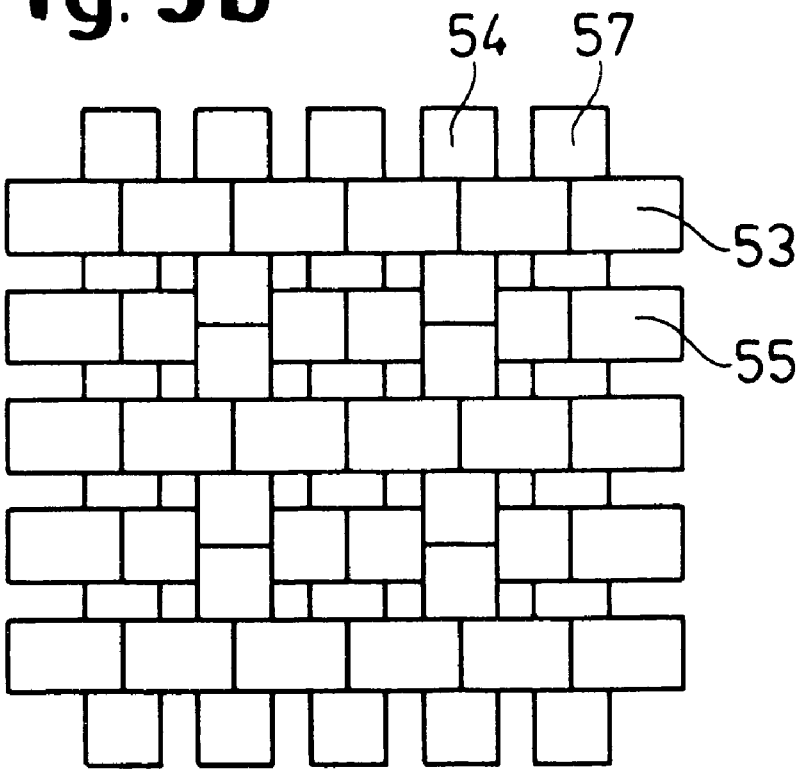
FIG. 5*b* is a plan view of the bar insert shown in FIG. 5*a;*
Figure 5C:
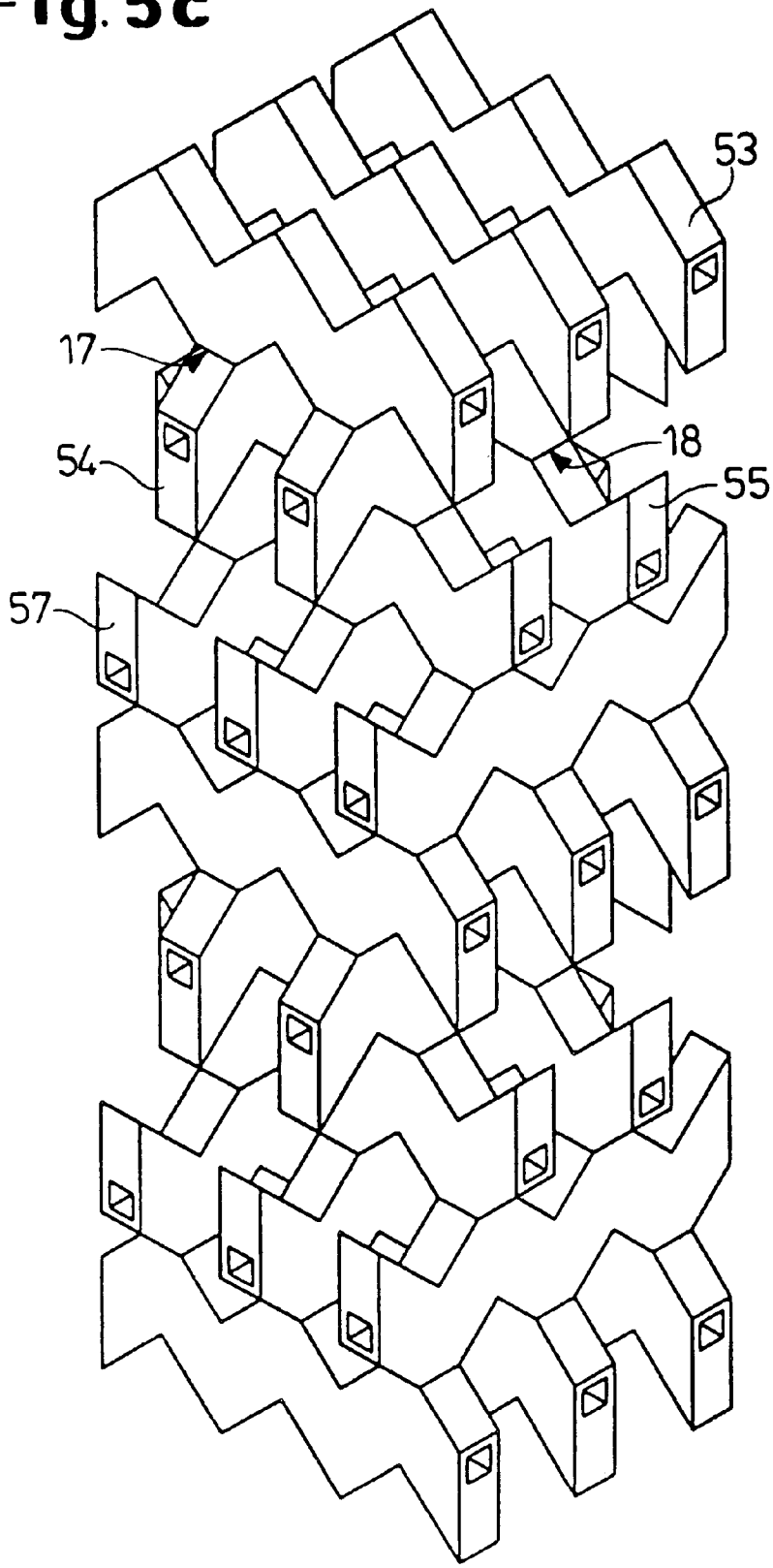
FIG. 5*c* is an isometric view corresponding to FIG. 3*a;*

FIGS. 5*a* to 5*c* show a variant of the bar insert shown in FIG. 3*a,* which can be produced by means of casting technology and which is employed as an insert in an inner housing 2 corresponding to that shown in FIG. 2.

As distinct from FIG. 3*a,* the edges of adjacent bars 53 ,54 or 54, 55 abut each other at straight faces, and comprise no mutually interleaved recesses. The heat transfer channels are 56 are of straight construction and can be produced by means of mould slides for the pre-form. The intermediate spaces 58 between the bars 57, 55 can also be produced by mould slides during the production of the pre-form.

The zigzag bars 53 or 54 are each joined to the bars 54, 55 of the layer of bars underneath at the junction points 17 or 18. The individual segments of the bars 53 and 54 or 54 and 55, respectively, each span a tetrahedron at a junction point 17 or 18.

Example 4

Figure 6:
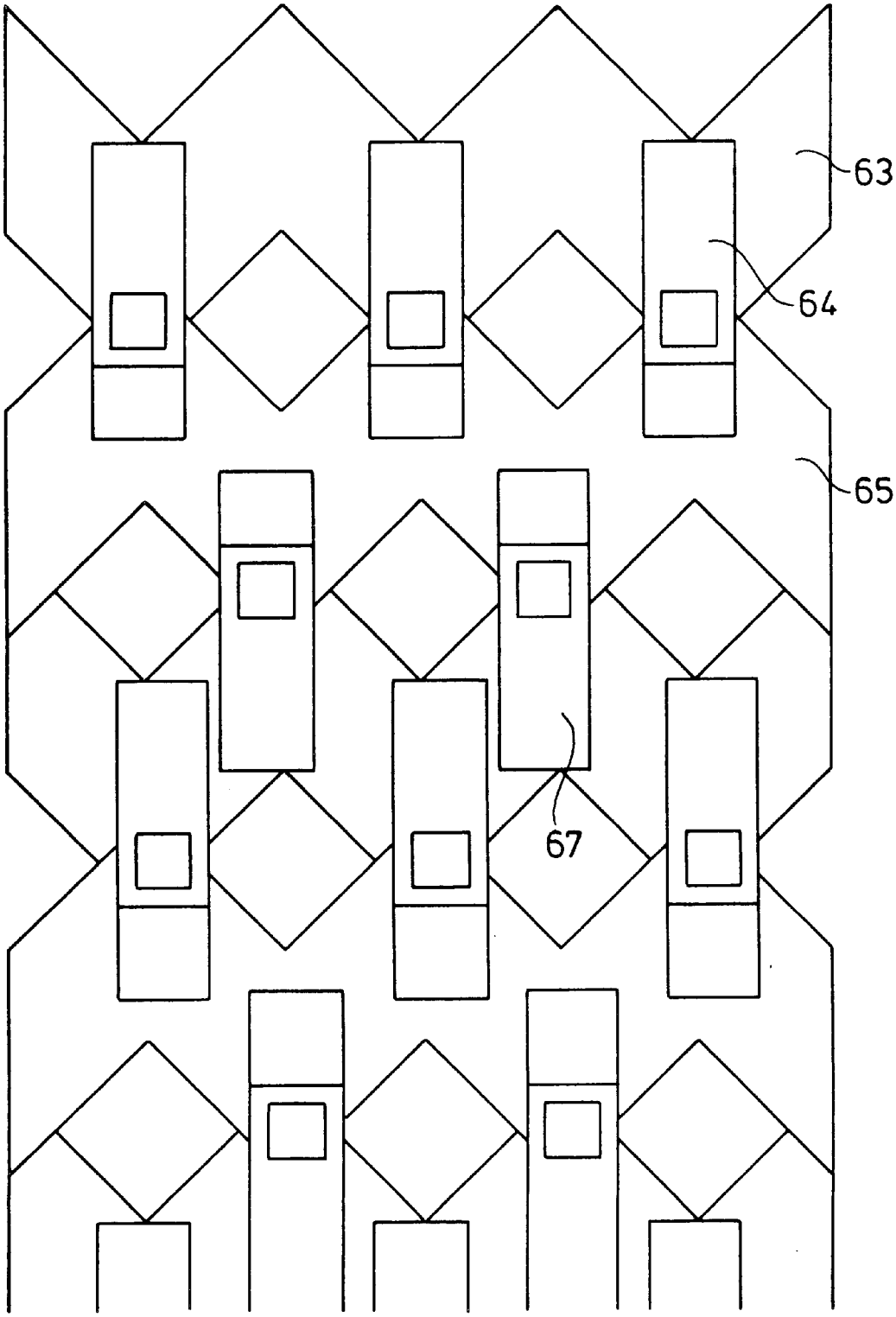
FIG. 6 shows the bar insert of a variant of the mixer shown in FIG. 1*a,* comprising lateral displacement of the bars in layers of bars situated one above another.

In the mixer according to Example 1, flow pockets which are not mixed can still possibly occur. In order to prevent this, the symmetry with respect to the direction of flow has to be broken. This is possible by shearing the grid planes with respect to the direction of flow. The arrangement illustrated in FIG. 6 shows that this can be achieved by an irregular lateral displacement layers of bars 63, 65 or 64, 67 which are next to each other in each case.

Example 5

Figure 7:
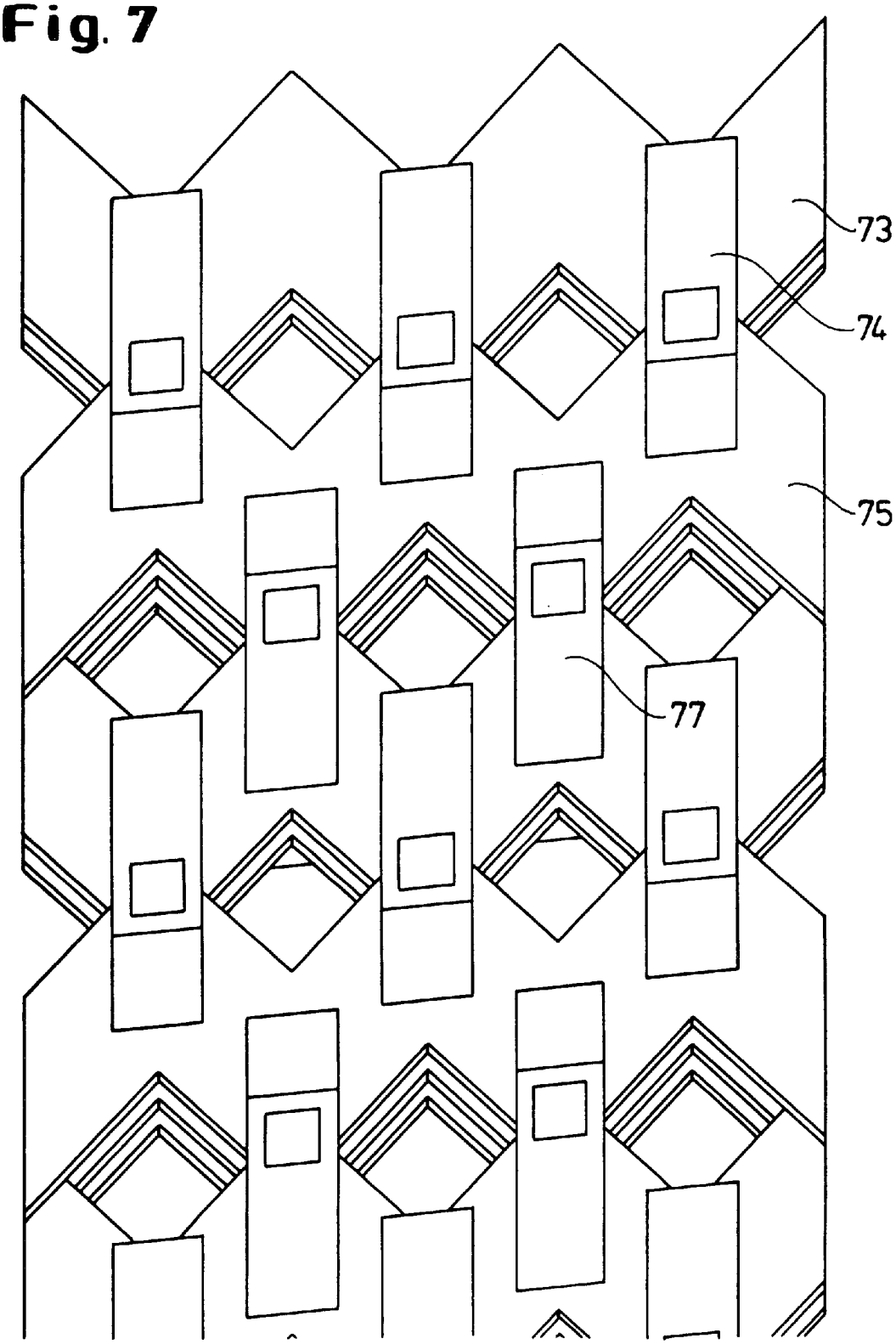
FIG. 7 shows the bar insert of a variant of the mixer show n in FIG. 1*a,* comprising bars which run obliquely to the main direction of flow in layers of bars situated one above another.

Another option for breaking the symmetry is to displace the grid planes perpendicularly to the direction of flow. FIG. 7 shows a bar insert in which the bars 73 of a layer of bars are arranged so that their vertices form a plane which is at an angle of about 85° to the main direction of flow.

The upper vertices of each individual bar 73, 74, 75, 77 are each disposed ascending by about 5° as seen from the heat transfer medium inlet side (on the left of or behind FIG. 7). It is also possible by this means to prevent the formation of preferential flow pockets.

Example 6

Figure 8A:
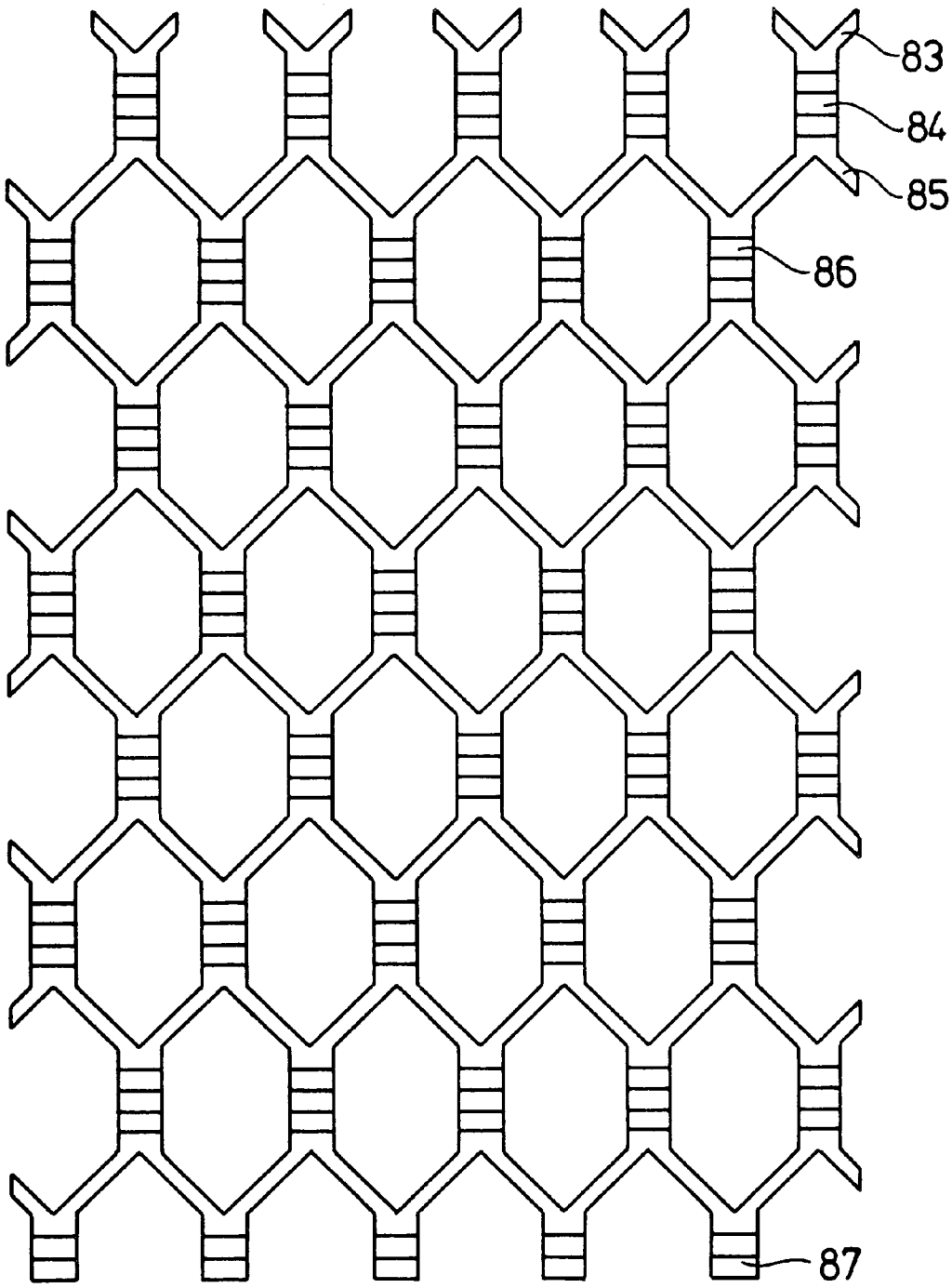
FIG. 8*a* is a side view of a static mixer according to the invention without heating channels. The housing is not illustrated.
Figure 8B:
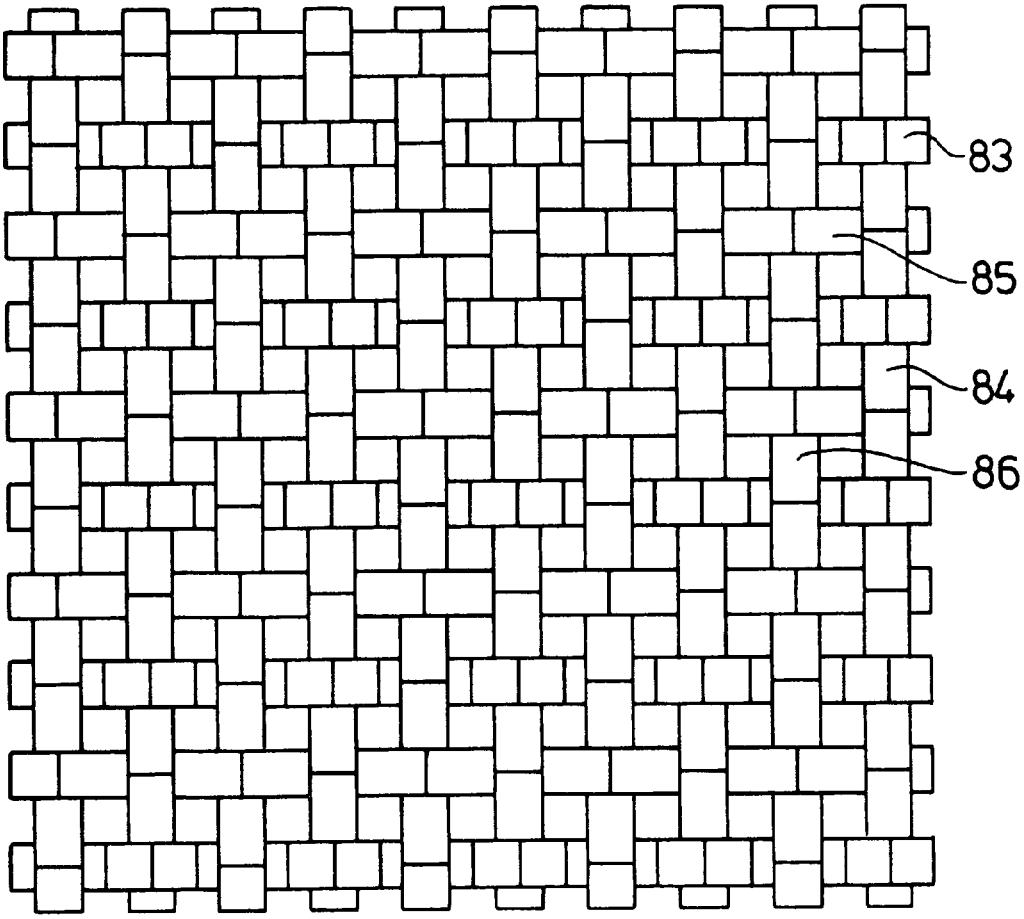
FIG. 8*b* is a plan view of the mixer shown in FIG. 8*a;*
Figure 8C:
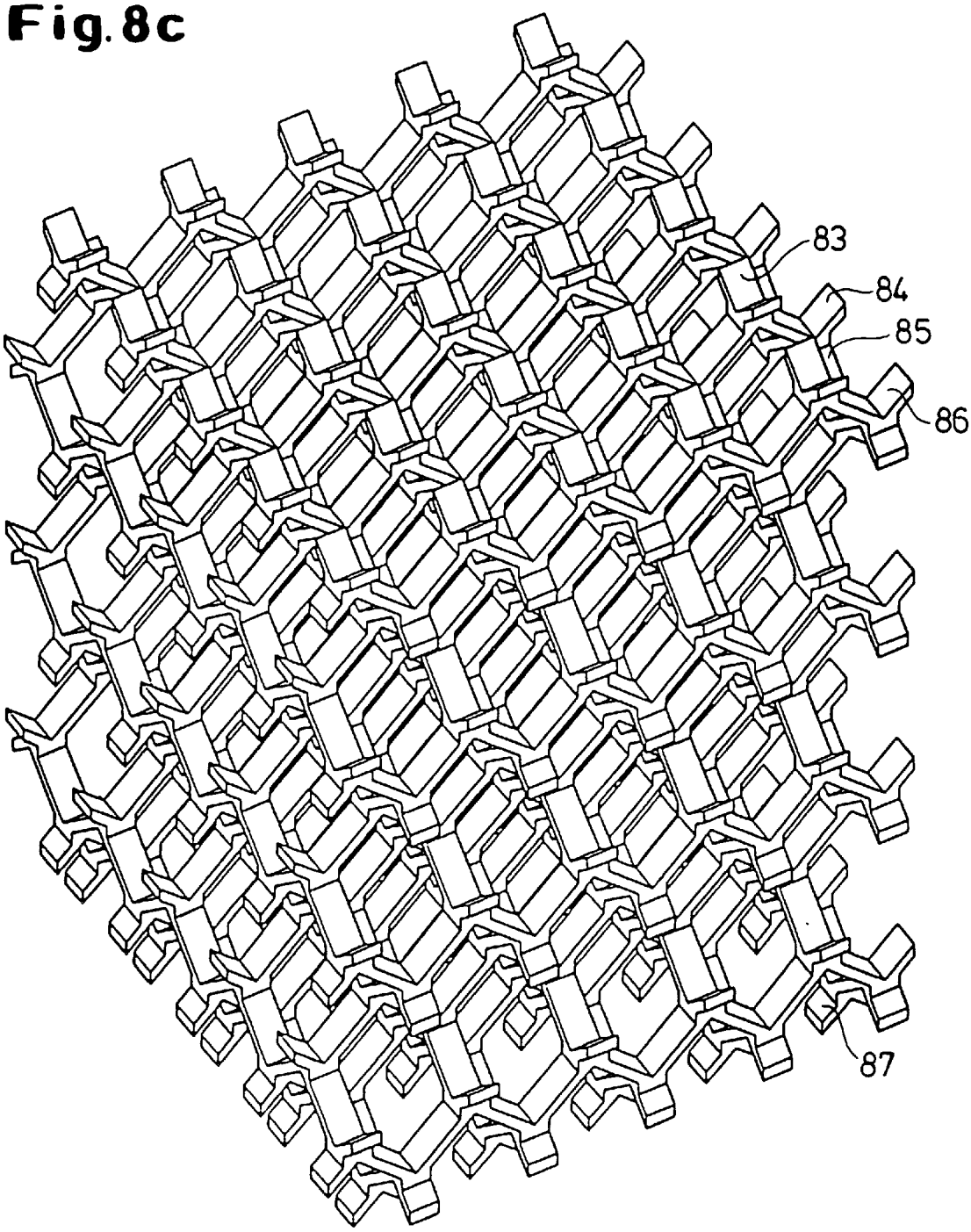
FIG. 8*c* is a perspective view of the mixer shown in FIG. 8*a;*.

FIGS. 8*a* to 8*c* illustrate a variant of the bar insert shown in FIGS. 5*a* to *c* in which the bars (83, 84, 85, 86) have no heating channels.

The uppermost layer of bars (83) and the lowest layer of bars (87) are shown partly interrupted.

What is claimed is:

1. A static mixer apparatus for mixing viscous fluids, which is constructed at least from an inner housing which has an inlet for material to be mixed and an outlet for mixed material and which comprises two or more layers of undulating or zigzag bars which are parallel to each other and which are disposed one above another rotated by an angle $\alpha$, to each other in an alternating manner and which are joined to each other at their upper or lower vertices.

2. An apparatus according to claim 1, wherein at least some of the bars of the layers are provided with channels for the passage of a heat transfer fluid.

3. An apparatus according to claim 1, wherein the apparatus is subdivided into two or more separate segments which are stacked one above the other and in each of which two, three or more layers of bars are joined together.

4. An apparatus according to claim 3, wherein the segments comprise three layers of bars.

5. An apparatus according to claim 1, wherein the bars of directly superimposed layers of bars overlap at their junction points by means of recesses which fit within one another at their vertices.

6. An apparatus according to claim 1, wherein the parallel bars of a layer of bars are disposed laterally displaced in relation to the center spacing of adjacent bars of the next layer of bars situated above or below.

7. An apparatus according to claim 1, wherein the layers of bars are set at an angle $\beta$, which is less than or greater than 90°, in relation to the main direction of flow of the material to be mixed from the inlet for material to be mixed to the outlet for mixed material.

* * * * *

UNITED STATES PATENT AND TRADEMARK OFFICE

CERTIFICATE OF CORRECTION

PATENT NO. : 6,217,208 B1
DATED : April 17, 2001
INVENTOR(S) : Heinrich Schuchardt It is certified that error appears in the above-identified patent and that said Letters Patent is hereby corrected as shown below:

Title page,
The Title should read -- Heatable Static Mixing Device --.

ABSTRACT,
Line 9, "(3,1; 4, 14)" should read -- (3, 13; 4, 14) --.

Column 3,
Line 7, "3a" should read -- 5a --.

Signed and Sealed this

Eighteenth Day of December, 2001

*Attest:*

*Attesting Officer*

JAMES E. ROGAN
*Director of the United States Patent and Trademark Office*